US005590701A

United States Patent [19]

Fukase

[11] Patent Number: 5,590,701

[45] Date of Patent: Jan. 7, 1997

[54] STRIP CASTER

[75] Inventor: Hisahiko Fukase, Tokyo, Japan

[73] Assignees: Ishikawajima-Harima Heavy Industries Co., Ltd., Tokyo, Japan; BHP Steel (JLA) Pty Ltd., Sydney, Australia

[21] Appl. No.: 351,475

[22] PCT Filed: May 31, 1993

[86] PCT No.: PCT/AU93/00254

§ 371 Date: Dec. 21, 1994

§ 102(e) Date: Dec. 21, 1994

[87] PCT Pub. No.: WO94/02269

PCT Pub. Date: Feb. 3, 1994

[30] Foreign Application Priority Data

Jul. 21, 1992 [AU] Australia ..... PL3713

[51] Int. Cl.[6] ..... B27D 11/00; B27D 11/06

[52] U.S. Cl. ..... 164/415; 164/428

[58] Field of Search ..... 164/480, 428, 164/415, 475

[56] References Cited

U.S. PATENT DOCUMENTS 4,986,336 1/1991 Fukase et al. ..... 164/415

FOREIGN PATENT DOCUMENTS 3-66453 3/1991 Japan ..... 164/428

3-86359 4/1991 Japan ..... 164/428

OTHER PUBLICATIONS

Patent Abstracts of Japan, M-1183, p. 69, JP,A,3-198951.

Patent Abstracts of Japan, M-1008, p. 112, JP,A,2-133149.

*Primary Examiner*—Kuang Y. Lin

*Attorney, Agent, or Firm*—Nikaido, Marmelstein, Murray & Oram LLP

[57] ABSTRACT

A metal strip casting apparatus has parallel casting rolls having a nip between them, and a molten metal delivery device for delivery of molten metal into the nip. A casting pool of molten metal is formed in the nip, and pool confining members engage the casting rolls at opposite ends of the nip. A roll drive apparatus is provided to drive the casting rolls in opposite directions, to form a metal strip at the nip. A first chamber forming device extends from the metal delivery means to the casting rolls, to form a pressurizing chamber. Pressurizing chamber seals are formed with the casting rolls on either side of the casting pool. A second chamber forming device is provided, and extends to the rolls to form a gas sealing chamber about the pressurizing chamber, and forms sealing chamber seals with the casting rolls. Gas escaping the pressurizing chamber through the pressure chamber seals will therefore enter the gas sealing chamber. A non-oxidizing gas is delivered to the pressurizing chamber. A second gas is delivered to the sealing chamber to pressurize the sealing chamber. A pressure control device is provided to maintain a superatmospheric pressure of the second gas in the sealing chamber. The configuration inhibits leakage of the non-oxidizing gas from the pressurizing chamber.

10 Claims, 6 Drawing Sheets

STRIP CASTER

TECHNICAL FIELD

This invention relates to twin roll strip casters for continuously casting metal strip. In a caster of this type, molten metal is delivered into the nip between a pair of chilled casting rolls to form a casting pool in contact with the peripheral walls of the casting rolls. Two skins of metal solidify on the roll surfaces and these skins are brought together at the nip to form a solidified strip which issues continuously from the nip. The molten metal may be delivered to the nip between the rolls by means of a tundish and a metal delivery nozzle located immediately above the nip between the rolls.

It has previously been proposed to pressurise the casting pool surface in order to enhance heat transfer from the metal to the rolls. More specifically, U.S. Pat. No. 4,986,336 discloses an arrangement for pressurising the casting pool surface by forming a pressurising chamber between the rolls and the tundish by means of walls which curve downwardly from the tundish and are fitted at their lower edges with sliding seals to engage the casting rolls to seal the pressurising chamber. This patent also refers to a previous proposal to form a much larger pressurising chamber entirely surrounding the tundish.

One problem in the operation of apparatus with a casting pool pressurising chamber is that gas tends to escape from the chamber at the seals with the roll surfaces. In order to control the atmosphere above the casting pool expensive gases may be used, for example an inert gas such as argon, and such gas leakage may be very costly. The present invention provides an improved sealing arrangement by which it is possible to drastically reduce leakage of gas from the pressurising chamber.

DISCLOSURE OF THE INVENTION

According to the invention there is provided metal strip casting apparatus comprising:

- a pair a parallel casting rolls forming a nip between them;
- molten metal delivery means for delivery of molten metal into the nip between the casting rolls to form a casting pool of molten metal in the nip;
- pool confining members to engage the casting rolls at opposite ends of the nip to confine the casting pool in the nip;
- roll drive means to drive the casting rolls in mutually opposite directions to form a metal strip from metal in the pool and to pass that strip downwardly from the nip;
- first chamber forming means to form a pressurising chamber for gas pressurising of the casting pool surface and forming chamber seals with the casting rolls to each side of the nip;
- second chamber forming means to form a gas sealing chamber about the pressurising chamber such that gas escaping the pressurising chamber through said seals will enter the gas sealing chamber;
- means for delivering a first gas to the pressurising chamber;
- means for delivering a second gas to the sealing chamber; and
- means to maintain the first gas in the pressurising chamber at a pressure at least as great as the pressure of the second gas in the sealing chamber.

Preferably the metal delivery means comprises a tundish disposed above the casting rolls and a metal delivery nozzle disposed beneath the tundish to receive molten metal from the tundish and to deliver it into the nip between the casting rolls, The first chamber forming means may comprise a structure extending from the metal delivery means and comprising a pair of pressurising chamber side walls extending longitudinally of the rollers one to each side of the nip and pressuring chamber sealing means at lower margins of those side walls to form said chamber seals. Said structure may be extended from the metal delivery nozzle or from the tundish of the metal delivery means.

Preferably further the second chamber forming means comprises a pair of sealing chamber side walls extending longitudinally of the rolls outside the pressure chamber side walls and sealing chamber sealing means at lower margins of the sealing chamber side walls to form sealing chamber seals with the casting rolls, The sealing chamber side walls may be connected to said structure defining the pressurising chamber side walls.

BRIEF DESCRIPTION OF THE DRAWINGS

In order that the invention may be more fully explained one particular embodiment will be described in some detail with reference to the accompanying drawings in which.

DETAILED DESCRIPTION OF THE PREFERRED EMBODIMENT

Figure 1:
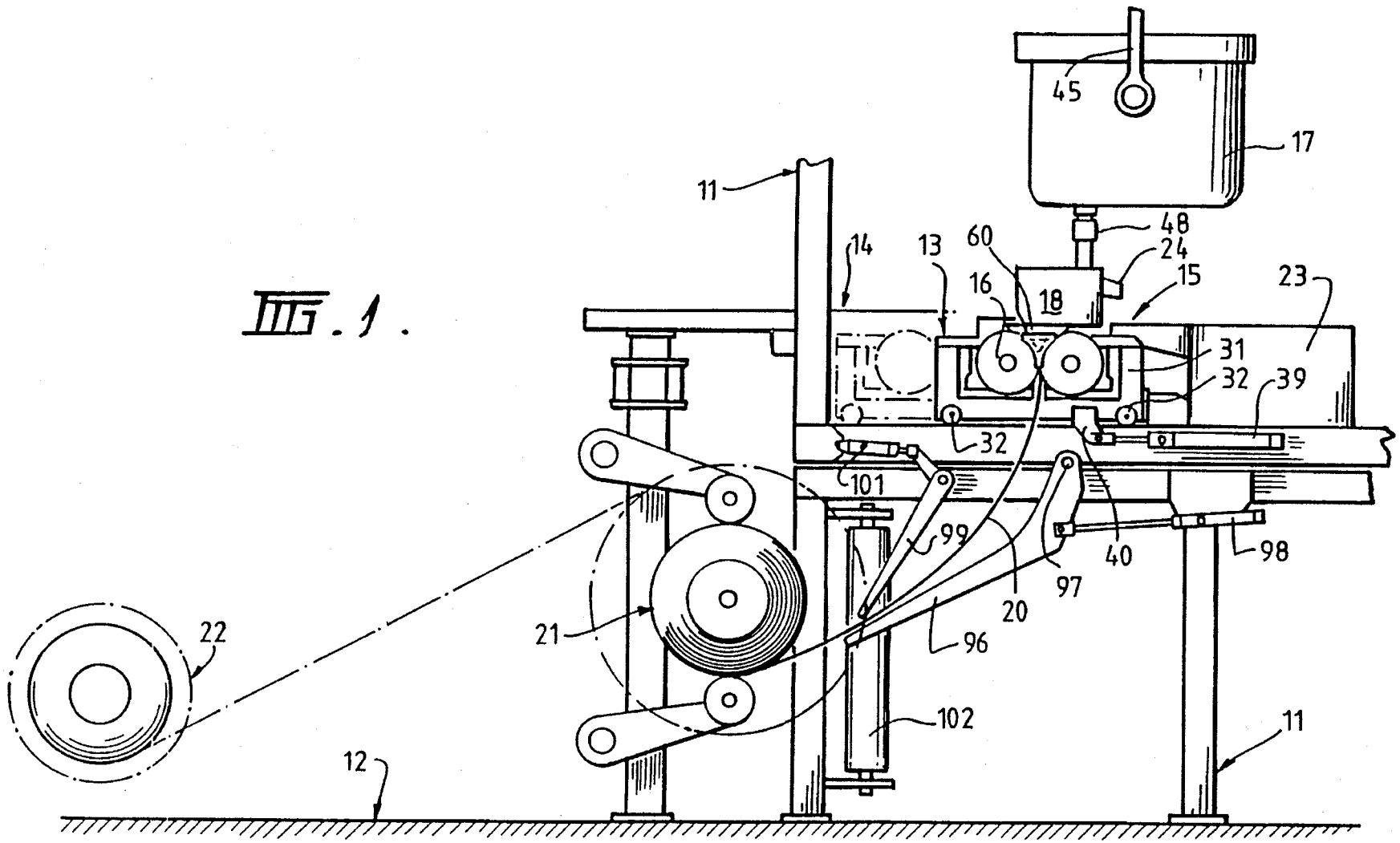
FIG. 1 illustrates a continuous strip caster constructed in accordance with the invention.
Figure 2:
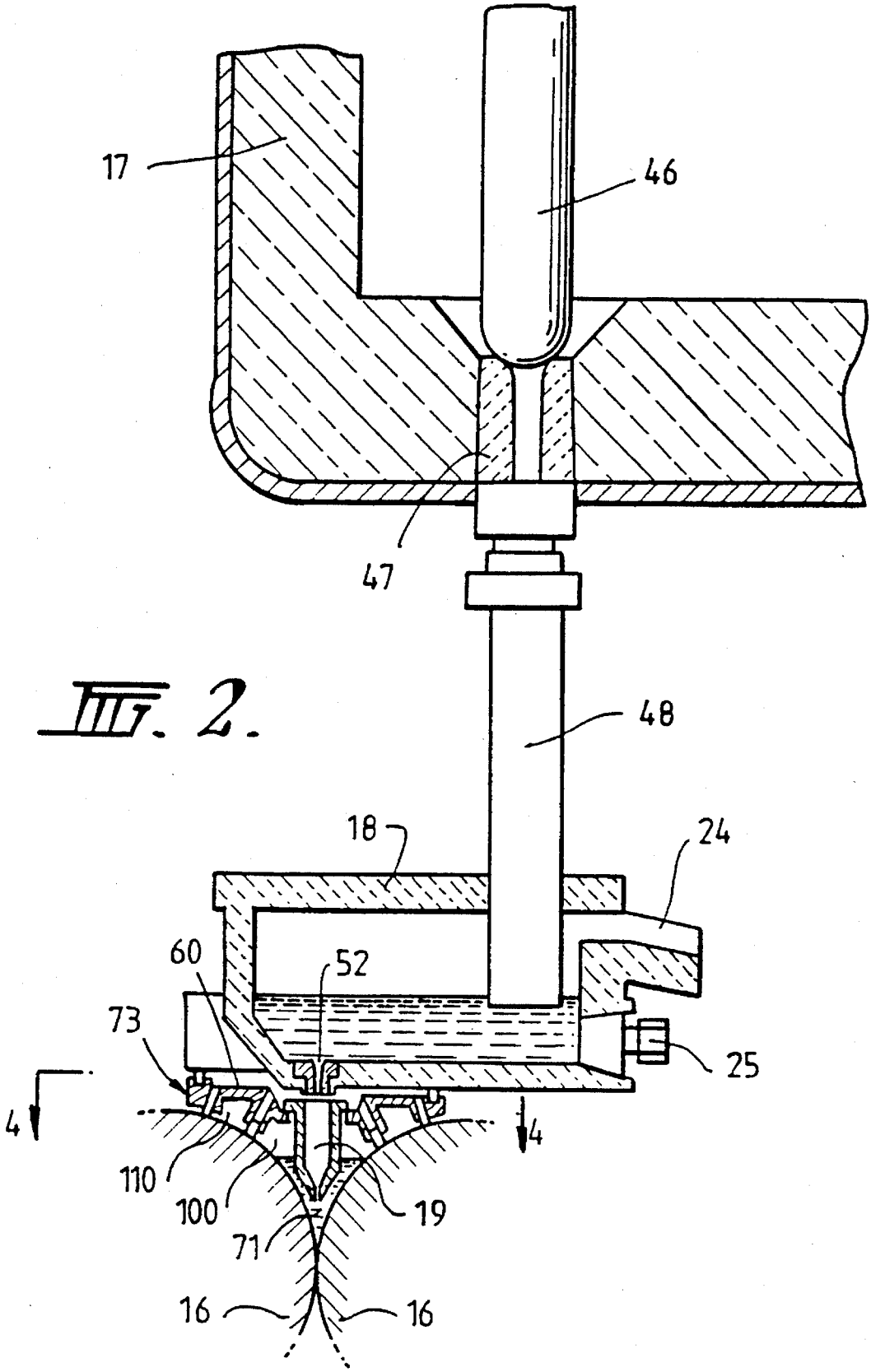
FIG. 2 is a vertical cross-section through important components of the caster illustrated in FIG. 1.
Figure 3:
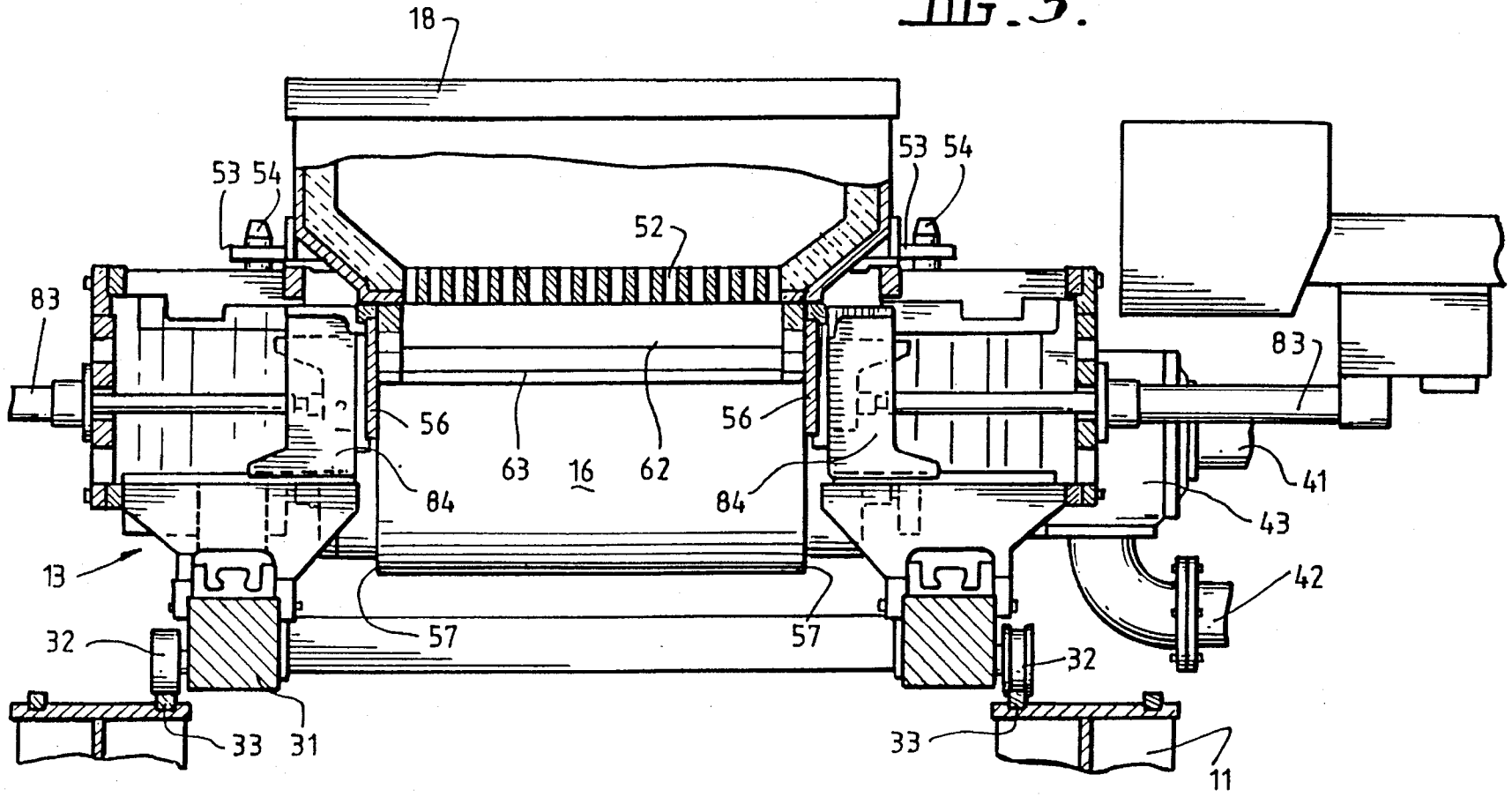
FIG. 3 is a further vertical cross-section through important components of the caster taken transverse to the section of FIG. 2.
Figure 4:
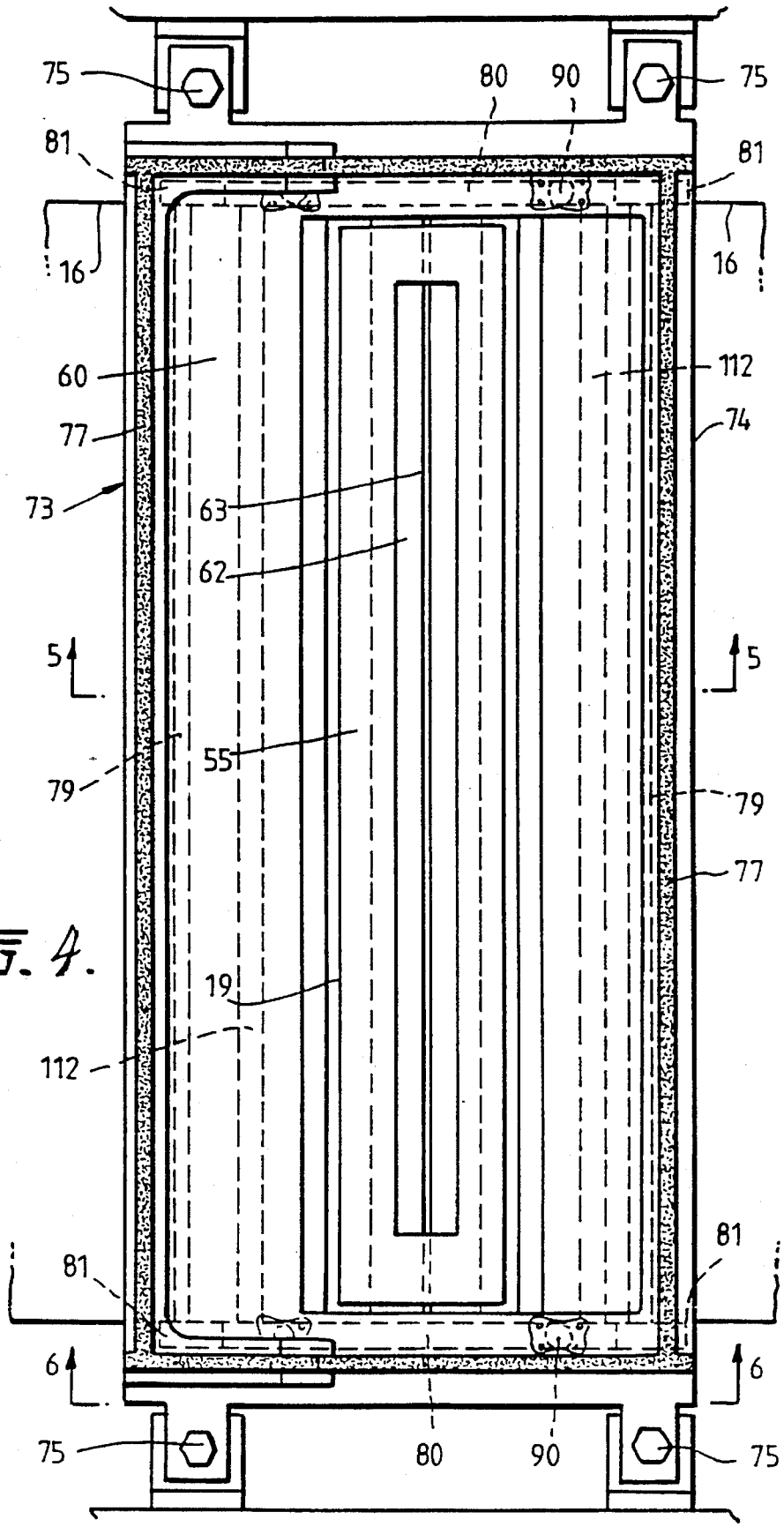
FIG. 4 is a view generally on the line 4—4 in FIG. 2.
Figure 5:
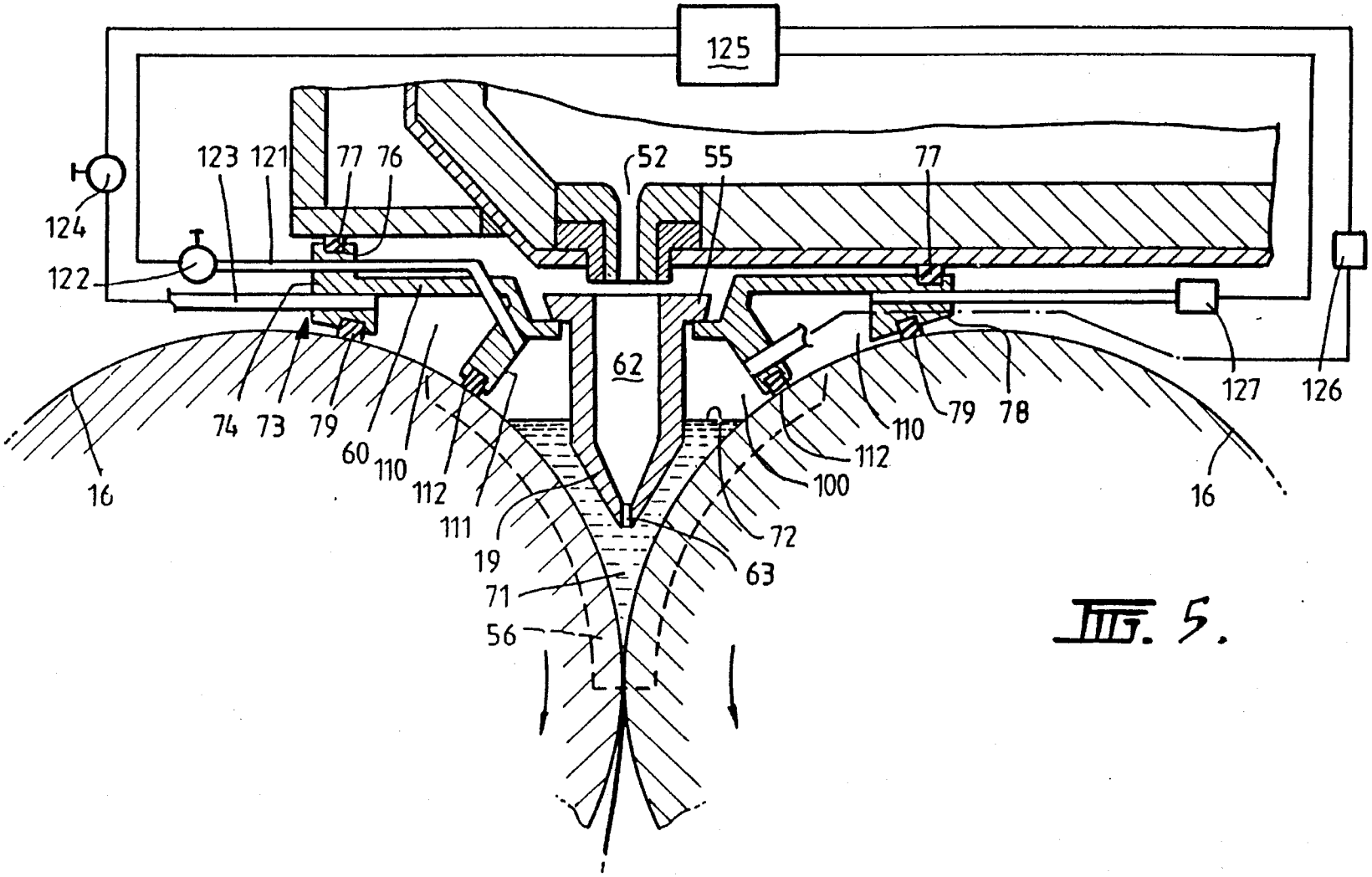
FIG. 5 is a cross-section on the line 5—5 in FIG. 4.
Figure 6:
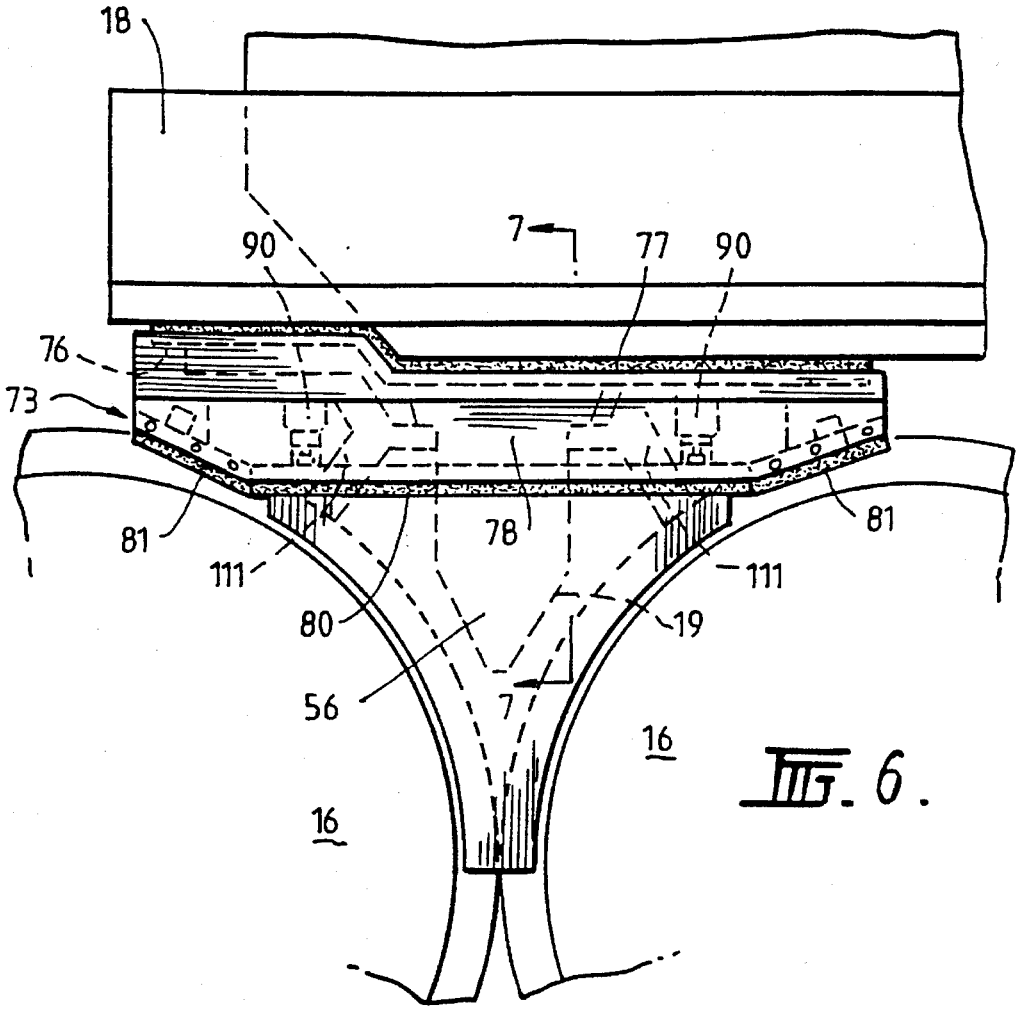
FIG. 6 is a cross-section on the line 6—6 in FIG. 4.
Figure 7:
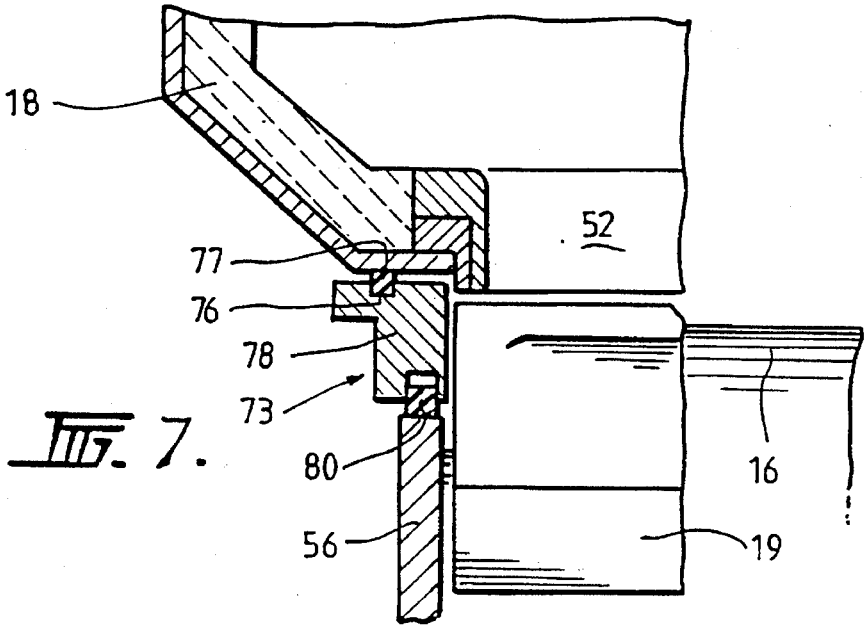
FIG. 7 is a cross-section on the line 7—7 in FIG. 6.

The illustrated caster comprises a main machine frame 11 which stands up from the factory floor 12. Frame 11 supports a casting roll carriage 13 which is horizontally movable between an assembly station 14 and a casting station 15. Carriage 13 carries a pair of parallel casting rolls 16 to which molten metal is supplied during a casting operation from a ladle 17 via a tundish 18 and delivery nozzle 19. Casting rolls 16 are water cooled so that shells solidify on the moving roll surfaces and are brought together at the nip between them to produce a solidified strip product 20 at the roll outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the tundish or by withdrawal of an emergency plug 25 at one side of the tundish if there is a severe malformation of product or other severe malfunction during a casting operation.

Roll carriage 13 comprises a carriage frame 31 mounted by wheels 32 on rails 33 extending along part of the main machine frame 11 whereby roll carriage 13 as a whole is mounted for movement along the rails 33. Carriage frame 31 carries a pair of roll cradles in which the rolls 16 are rotatably mounted. Carriage 13 is movable along the rails 33 by actuation of a double acting hydraulic piston and cylinder unit 39, connected between a drive bracket 40 on the roll carriage and the main machine frame so as to be actuable to move the roll carriage between the assembly station 14 and casting station 15 and visa versa.

Casting rolls 16 are contra-rotated through drive shafts 41 from an electric motor and transmission. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The rolls may typically be about 500 mm diameter and up to 1300 mm long in order to produce 1300 mm wide strip product.

Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into tundish 18.

Tundish 18 is also of conventional construction. It is formed as a wide dish made of a refractory material such as magnesium oxide (MgO). One side of the tundish receives molten metal from the ladle and is provided with the aforesaid overflow 24 and emergency plug 25. The other side of the tundish is provided with a series of longitudinally spaced metal outlet openings 52. The lower part of the tundish carries mounting brackets 53 for mounting the tundish onto the roll carriage frame 31 and provided with apertures to receive indexing pegs 54 on the carriage frame so as accurately to locate the tundish.

Delivery nozzle 19 is formed as an elongate body made of a refractory material such as alumina graphite. Its lower part is tapered so as to converge inwardly and downwardly so that it can project into the nip between casting rolls 16. A mounting bracket 60 is provided to support the nozzle from the underside of tundish 18 and the upper part of the nozzle is formed with outwardly projecting side flanges 55 which locate on the mounting bracket.

Delivery nozzle 19 has an internal vertically extending passage 62 to receive liquid flowing downwardly through the openings 52 of the tundish. Passage 62 converges toward its lower end part which serves as an outlet flow passage for flow of metal into the nip between the rolls 16. More specifically, the lower part of passage 62 terminates at an elongate outlet slot 63 at the bottom end of the delivery nozzle which slot extends longitudinally of the nip between the casting rolls.

During a casting run molten metal delivered from the delivery nozzle forms a pool 71 above the nip between the rolls, this pool being confined at the ends of the rolls by a pair of side closure plates 56 which are held against stepped ends 57 of the rolls by actuation of a pair of hydraulic cylinder units 83 fitted with closure plate holders 84. The upper surface 72 of pool 71, generally referred to as the "meniscus level" rises above the lower end of the delivery nozzle. Accordingly, the lower end of the delivery nozzle is immersed within this pool and the nozzle outlet passage extends below the surface of the pool or meniscus level. The flow of metal is also such as to produce a head of molten metal within the nozzle outlet passage to a height above the meniscus level 72.

In accordance with the invention, a space above the pool of molten metal between the casting rolls is enclosed by an enclosure means denoted generally as 73 and defining an inner pressurising chamber 100 surrounded by an outer gas sealing chamber 110. Enclosure means 73 comprises a rectangular perimeter frame 74 bolted to the roll carriage by bolts 75. Frame 74 supports the nozzle mounting bracket 60 and that bracket may indeed be formed integrally with the frame. Frame 74 is formed with an upwardly facing groove 76 to receive a rectangular sealing strip or gasket 77 which seals against the underside of the tundish structure when the tundish is lowered onto the roll carriage. Frame 74 is further formed with a pair of outer side enclosure walls 78 provided at their lower edges with gas tight sliding seals 79 which slide on upper surfaces of the casting rolls 16 and a pair of inner chamber side walls 111 similarly provided at their lower edges with sliding seals 112.

The two end walls of perimeter frame 74 extend across the top of the side closure plates 56 and are fitted with vertically movable sealing strips 80 to seal against the upper edges of the side closure plates 56 and two fixed outer sealing strips 81 which seal against the rolls at the ends of the frame thereby to complete sealing of the chambers 100 and 110.

Movable sealing strips 80 can be raised and lowered in frame 74 by operation of four gas cylinder actuators 90 disposed in housings within the end walls of the frame. Those strips are raised to retracted positions until the end plates 56 have been brought against the rolls but are extended downwardly against the end plates immediately prior to casting.

The outer chamber 110 surrounds the side walls 111 of the pressurising chamber 100 such that any gas escaping from the pressurising chamber 100 through the seals 112 will enter this outer chamber 110.

Pressurising chamber 100 is charged with an inert gas such as argon via a supply pipe 121 which extends through one of the outer chamber walls 78 and one of the inner chamber walls 111 to communicate with the pressurising chamber. Pipe 121 is connected to a pressurised supply of the appropriate gas through a pressure regulating valve 122 to hold the pressure of gas within the pressurising chamber 100 at an appropriate super-atmospheric pressure. Outer chamber 110 is charged with pressurised air or some other inexpensive gas via a charging pipe 123 provided with a pressure regulator 124. The pressure regulators 122, 124 for the two gases are both connected to a pressure controller 125 which monitors the gas pressures in the two chambers 100, 110 through signals received from respective pressure transducers 126, 127. Controller 125 is programmed so that the pressure of gas in the outer chamber 110 is always equal to or slightly less than the pressure of the inert gas in the pool pressurising chamber 100. In this way there is a pressure balance across the pressurising chamber sealing means 112 which drastically reduces the leakage of the expensive inert gas which would otherwise occur if the outer sides of the seals 112 were exposed directly to atmospheric pressure. Thus the gas in the outer chamber 110 serves as a buffer which limits the escape of the inert gas from the pressurising chamber 100 to a very low level and although there may be significant leakage of gas from chamber 110 to atmosphere through the seals 79 this is not a problem since the buffering gas can be air or some other cheap gas.

In a typical ferrous metal caster constructed in accordance with the invention, the width of the slot outlet from the nozzle may be in the range 1.5 mm to 7 mm, for example around 3 mm. During a casting run the head of metal formed in the nozzle outlet passage may typically be about 20 mm above the meniscus level 72.

The head end of strip 20 produced on initial pouring is guided by actuation of an apron table 96 to the jaws of coiler 21. Apron table 96 hangs from pivot mountings 97 on the main frame and can be swung toward the coiler by actuation of an hydraulic cylinder unit Table 96 may operate against an upper strip guide flap 99 actuated by a piston and cylinder unit 101 and the strip may be confined between a pair of vertical side rollers 102. After the head end has been guided into the jaws of the coiler, the coiler is rotated to coil the product and the apron table is allowed to swing back to its inoperative position where it simply hangs from the machine frame clear of the product which is taken directly onto coiler 21. The resulting strip product may be subsequently transferred to coiler 22 to produce a final coil for transport away from the caster.

The illustrated apparatus has been advanced by way of example only and it could be modified considerably. For example, the pressurising chamber and the outer sealing chamber could be formed by walls extended from the tundish rather than from the structure supporting the metal delivery nozzle. In a further modification the pressurising chamber could be formed by walls extended to the roller surfaces directly from the metal delivery nozzle so as to produce a relatively small pressurising chamber. In this case the outer chamber could be formed by walls extending from the nozzle support structure or from the tundish. Because of the sealing with a buffering gas, the performance of seals 79 and 112 is not particularly critical and is not necessary to use close-fitting sliding seals. It would be quite possible to use fine brushes to engage the roll surfaces and provide an adequate sealing function. Additional roll cleaning brushes could be installed to clean the roll surfaces before they come into contact with the sealing brushes. It is to be understood that these modifications and many other variations will fall within the scope of the appended claims.

I claim:

1. A metal strip casting apparatus, comprising:

a pair of parallel casting rolls forming a nip between them;

molten metal delivery means for delivery of molten metal into the nip to form a casting pool of molten metal in the nip;

pool confining members to engage the casting rolls at opposite ends of the nip to confine the casting pool in the nip;

roll drive means to drive the casting rolls in mutually opposite directions to form a metal strip from the casting pool and to pass the metal strip downwardly from the nip;

first chamber forming means comprising a first structure extending from the metal delivery means to the rolls to form a pressurizing chamber for gas pressurizing of the casting pool surface and forming pressurizing chamber seals with the casting rolls to each side of the casting pool;

second chamber forming means comprising a second structure disposed about said first structure and extending to the rolls to form a gas sealing chamber about the pressurizing chamber and forming sealing chamber seals with the casting rolls such that gas escaping the pressurizing chamber through the pressure chamber seals will enter the gas sealing chamber;

means for delivering a non-oxidizing gas to the pressurizing chamber to pressurize pressuring chamber with the non-oxidizing gas at superatmospheric pressure;

means for delivering a second gas to the sealing chamber to pressurize the sealing chamber with the second gas at superatmospheric pressure; and pressure control means for regulating the non-oxidizing gas delivering means and the second gas delivering means to maintain the superatmospheric pressure of the second gas in the sealing chamber at a value which is equal to or slightly less than superatmospheric pressure of the non-oxidizing gas in the pressurizing chamber to inhibit leakage of the non-oxidizing gas from the pressurizing chamber.

2. A metal strip casting apparatus as claimed in claim 1, wherein said first structure comprises a pair of pressurizing chamber side walls extending longitudinally of the rolls one to each side of the nip and pressurizing chamber sealing means at lower margins of those side walls to form said chamber seals.

3. A metal strip casting apparatus as claimed in claim 2, wherein said chamber sealing means comprises sliding seal elements to slide on the peripheral surfaces of the casting rolls.

4. A metal strip casting apparatus as claimed in claim 2, wherein said second structure comprises a pair of sealing chamber side walls extending longitudinally of the rolls outside the pressure chamber side walls and sealing chamber sealing means at lower margins of the sealing chamber side walls to form sealing chamber seals with the casting rolls.

5. A metal strip casting apparatus as claimed in claim 4, wherein the sealing chamber side walls are connected to said first structure defining the pressurizing chamber side walls.

6. A metal strip casting apparatus as claimed in claim 1, wherein the molten metal delivery means comprises a tundish disposed above the casting rolls and a metal delivery nozzle disposed beneath the tundish to receive molten metal from the tundish and to deliver it into the nip between the casting rolls, wherein the metal delivery nozzle projecting into the pressurizing chamber.

7. A metal strip casting apparatus as claimed in claim 6, wherein said first structure extends from the metal delivery nozzle to the rolls.

8. A metal strip casting apparatus as claimed in claim 1, wherein the means for delivering the non-oxidizing gas to the pressurizing chamber and for delivering the second gas to the sealing chamber comprise respective pressure regulating valves and said pressure control means comprises a pressure controller effective to monitor gas pressures in the two chambers and to actuate one or both of the regulating valves.

9. A metal strip casting apparatus as claimed in claim 1, wherein the means for delivering a non-oxidizing gas to the pressurizing chamber comprises a source of argon gas to be supplied as the non-oxidizing gas.

10. A metal strip casting apparatus as claimed in claim 1, wherein the means for delivering a second gas to the sealing chamber is such as to supply air to the sealing chamber as the second gas.

* * * * *